United States Patent [19]

Roberts

[11] 4,109,495

[45] Aug. 29, 1978

[54] KEY AND TUMBLER CONSTRUCTION

[76] Inventor: Marvin E. Roberts, 2305 S. Arlington Ave., Reno, Nev. 89509

[21] Appl. No.: 810,508

[22] Filed: Jun. 27, 1977

Related U.S. Application Data

[63] Continuation-in-part of Ser. No. 671,010, Mar. 26, 1976, abandoned, which is a continuation of Ser. No. 505,367, Sep. 12, 1974, abandoned.

[51] Int. Cl.[2] ..... E05B 15/14; E05B 19/02; E05B 29/08

[52] U.S. Cl. ..... 70/365; 70/377; 70/406

[58] Field of Search ..... 70/403, 404, 365–366, 70/376, 377, 406, 409, 402, 403, 411

[56] References Cited

U.S. PATENT DOCUMENTS

| | | | |
|---|---|---|---|
| 1,635,724 | 7/1927 | Morris | 70/403 |
| 2,123,940 | 7/1938 | Gray | 70/377 |
| 3,789,638 | 2/1974 | Roberts | 70/366 |

FOREIGN PATENT DOCUMENTS

| | | | |
|---|---|---|---|
| 883,499 | 11/1961 | United Kingdom | 70/403 |

*Primary Examiner*—Robert L. Wolfe

[57] ABSTRACT

A key construction for use with a rotary disc-tumbler lock wherein longitudinal restricting wards in a plurality of cross-sectional profiles are formable along the key shank and a warding tumbler with a similarly shaped key entry opening, which warding tumbler is used in a lock associated with the warded key thereby providing a plurality of correspondingly shaped warding key entry openings in the lock and key profile configurations which permits locks and keys to be grouped into different series with a key from one group of locks being restricted from entering the locks of another group even though the bitting codes are the same.

6 Claims, 4 Drawing Figures

KEY AND TUMBLER CONSTRUCTION

This is a continuation-in-part of application Ser. No. 671,010, filed Mar. 26, 1976, abandoned which is a continuation of application Ser. No. 505,367, filed Sept. 12, 1974, abandoned.

BACKGROUND OF THE INVENTION

Lock cylinders with rotary disc tumblers have proven superior in the prevention of serruptitious entry means. This type of cylinder is gaining wide acceptance due to the relative ease of picking other types of cylinders.

The design and manufacture of keys of unique construction is a desirable element in the advancement of the art.

Unique key constructions that will operate bi-directional rotary disc-tumbler cylinders as in Roberts, et al. U.S. Pat. No. 3,789,638 are in demand and will advance the state of the art as to this type of cylinder.

Rotary disc-tumbler lock cylinders having key hole configurations that can be varied to produce cylinders in differing series, wherein each series will accept only keys of a given section are difficult to achieve without reducing the security of the cylinder. The Warding Tumbler construction accomplishes that result in a simple and economical method.

SUMMARY OF THE INVENTION

In general, there is provided herein an improved key construction for the operation of lock cylinders incorporating rotary disc tumblers including a warding tumbler construction for use in cooperation with a warded key for use with rotary disc-tumbler lock cylinders.

A key construction with a bitting structure which permits the selective operation of a rotary disc-tumbler lock cylinder in a clockwise or counterclockwise direction after insertion of the key into a single unobstructed key hole in the lock cylinder.

A key for the operation of a rotary disc-tumbler lock cylinder wherein the key shank is constructed with at least one warding groove along the longitudinal axis thereof for the purpose of restricting the insertion of the key into cylinders which are not provided with a correspondingly shaped key hole.

A warding tumbler construction for use in a rotary disc-tumbler lock cylinder wherein the warding tumbler has a key hole shaped to correspond to a warded key configuration to permit passage of a correspondingly shaped key, and to restrict other keys.

OBJECTS OF THE INVENTION

It is an object of this invention to provide an improved key for the operation of a bidirectional rotary disc-tumbler lock cylinder.

It is a further object of this invention to provide a key construction for use in conjunction with lock cylinders incorporating rotary disc tumblers wherein the coded bittings of the key consist of plane surfaces chordal to the key shank and which bittings, regardless of the code angle, engage the entire surface of a corresponding key contact surface on its associated tumbler in the lock cylinder.

It is a further object of this invention to provide an improved key construction for the operation of a lock cylinder incorporating rotary disc tumblers wherein the key is formed with a cross-sectional profile extending longitudinal of the key shank which profile serves to restrict that key for use in cylinders with a correspondingly shaped key entry opening.

It is a further object of this invention to provide a warding tumbler for use in conjunction with a rotary disc-tumbler lock cylinder wherein the key entry hole in the warding tumbler is shaped to restrict the insertion of keys whose cross-sectional shank profile is not formed to correspond to the shape of the key entry hole in the warding tumbler.

It is a further object of the invention to provide an improved key construction for use in conjunction with rotary disc-tumbler lock cylinders wherein the key is simple and economical to manufacture.

The foregoing and other objects of the invention will become more readily evident from the following detailed description of a preferred embodiment when considered in conjunction with the accompanying drawings.

DESCRIPTION OF A PREFERRED EMBODIMENT

Figure 1:
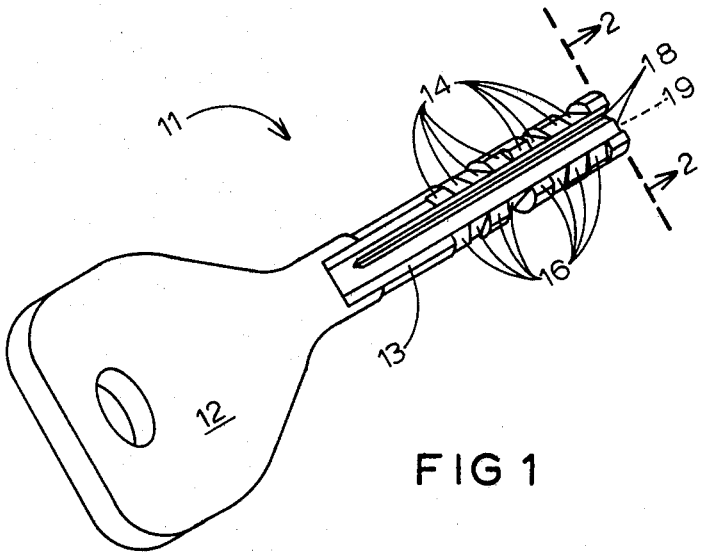
FIG. 1 is an isometric view of a key with bitting surfaces formed along the key shank and with warding grooves formed longitudinal of the key shank and parallel thereto.

Referring to FIG. 1, a key 11 of the type for use with a lock cylinder incorporating rotary disc tumblers, said key having a bow 12, a shank portion 13, warding grooves 18, 19 formed along shank 13 and parallel to its longitudinal axis, bitting planes 14, 16 formed along shank 13, planes 14 for use in cooperation with the rotary disc tumblers of a correspondingly coded lock cylinder in one direction of operation and planes 16 for use in cooperation with the rotary disc tumblers of said lock cylinder in the opposite direction of operation.

Figure 4:
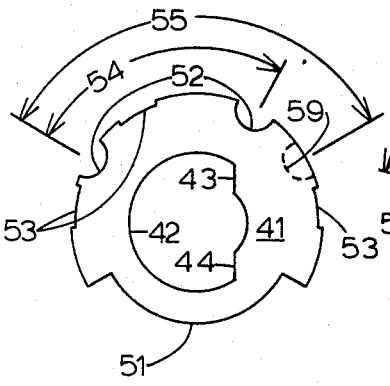
FIG. 4 is a plan view of a rotary disc tumbler with a key hole formed to cooperate with a key shank as in FIGS. 1 and 2.
Figure 2:
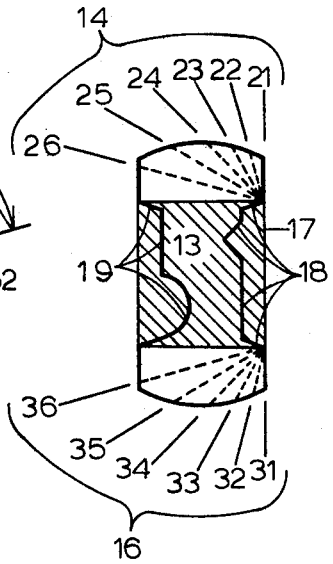
FIG. 2 is an end view of the shank of the key in FIG. 1 taken along lines 2—2 thereof.

While FIGS. 1 and 2 illustrate bitting planes 14, 16 formed along one side of key shank 13 and FIG. 4 illustrates a tumbler 41 with a key hole 42 formed to cooperate therewith, it will be readily apparent to those practiced in the art that bitting planes 14, 16 may be formed along the opposite side of key shank 13 with tumbler 41 reversed along the perpendicular center thereof to accommodate same.

Warding grooves 18, 19 are formable in a plurality of shapes along shank 13 within the shaded portion 17 of FIG. 2, the only restriction to the configuration of these grooves 18, 19 being that sufficient strength remain in shank 13 to support bitting planes 14, 16.

Bitting planes 14, 16 are formable at a plurality of angular positions as, for example, shown by lines 21 through 26 and 31 through 36 respectively in the same transverse position on shank 13 as best shown in FIG. 2.

Rotary disc tumbler 41 has a central key entry opening 42 with key contact surface 43 to cooperate with an associated one of bitting planes 14 and key contact surface 44 to cooperate with an associated one of bitting planes 16.

As will be obvious to those practiced in the art, a key with warding grooves formed along the shank portion thereof may be formed with only one set of bitting planes 14 or 16 on either side of shank 13 for the operation of a lock cylinder incorporating rotary disc tumblers having at least one gate opening position or notch 52 formed in the periphery of each tumbler.

Figure 3:
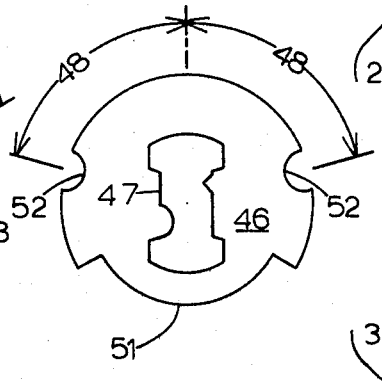
FIG. 3 is a plan view of a rotary disc warding tumbler with a key hole formed to cooperate with a warded key shank as in FIG. 1.

Warding rotary disc tumbler 46, FIG. 3, has a central key entry opening 47 of substantially the same shape as warded shank 13 of key 11 prior to bitting planes being formed on shank 13. Warding key entry opening 47 serves to restrict the insertion of key shanks whose cross-sectional configuration does not permit passage therethrough. Key entry opening 47 is formable in a plurality of shapes to correspond to any one of the plurality of cross-sectional configurations into which key shank 13 may be formed.

Because key entry opening 47 of warding tumbler 46 is substantially the same shape as the cross-section of shank 13 on a key for cooperation therewith, warding tumbler 46 will rotate with key 11 during the full initial rotation of key 11 necessary to align all the open gate tumbler positions 52 in a given lock cylinder for either direction of operation thereof, a gate position 52 is provided in warding tumbler 46 at this initial rotation angle 48 on at least one side of the vertical center line of warding tumbler 46. In a birotational lock, two such gate openings 52 are provided, each at angle 48 from the vertical centerline as in FIG. 3. A warding tumbler may be placed in a lock cylinder at any position normally occupied by a standard rotary disc tumbler.

I claim:

1. A key construction for use in cooperation with a lock incorporating rotary disc tumblers, said key having an elongate shank of a generally rectangular shape, said shank having two bittable portions formed thereonto, each of said portions extending lengthwise along said shank, said portions positioned opposite one another with said shank being centrally disposed therebetween, each of said portions being formed as truncated cylindrical segments whose common axis is coincidental with the rotational axis of said key, said shank being formed longitudinally parallel to its rotational axis in any one of a plurality of cross-sectional configurations, each of said configurations being formed with a maximum width across said cross-section of a lesser width than the width of either of said bittable portions.

2. A key construction according to claim 1 wherein a plurality of chordal planes are formed into at least one of said bittable portions, only one of said planes being formed at any one longitudinal position along said portion, said plains being offset from but parallel to the axis of key rotation, said planes being formable one to the other at a plurality of angles transverse of said shank, each of said planes serving as single bittings for cooperation with an associated tumbler in said lock, said bittings rotate said tumblers to coded gate opening positions by rotation of said key in said lock.

3. A key construction according to claim 1 wherein a plurality of chordal planes are formed into both of said bittable portions, only one of said planes being formed at any one longitudinal position along the one of said portions into which it is formed, said planes being offset from but parallel to the axis of key rotation, said planes being formable one to the other at a plurality of angles transverse of said shank, each of said planes serving as a single bitting for cooperation with an associated tumbler in said lock, said bittings in each one of said portions rotate said tumblers to coded gate opening positions by selective rotation of said key in said lock.

4. A key construction according to claim 1 wherein a plurality of chordal planes are formed into both of said bittable portions, only one of said planes being formed at any one longitudinal position along the one of said portions into which it is formed, said planes being offset from but parallel to the axis of key rotation, said planes being formable one to the other at a plurality of angles transverse of said shank, each of said planes serving as a single bitting for cooperation with an associated tumbler in said lock, said bittings in each one of said portions rotating said tumblers to coded gate opening positions by rotation after selective orientation of said key in said lock.

5. A warding rotary disc tumbler for use in a key-operated lock cylinder incorporating rotary disc tumblers and a sidebar locking element, said warding tumbler being formed with two gate openings or notches disposed to extend radially into the periphery thereof, said gate openings being arcuately displaced from alignment with said sidebar in the locked condition of said lock, one of said openings being aligned with said sidebar by clockwise rotation of said warding tumbler in said lock by said key, the other of said openings being aligned with said sidebar by counter-clockwise rotation of said warding tumbler in said lock by said key, said warding tumbler having a key entry opening formed in any one of a plurality of non-symmetrical configurations, said key entry opening in said warding tumbler serves to prevent relative movement between said warding tumbler and a correspondingly shaped key in the operation of said warding tumbler.

6. A warding rotary disc tumbler for use in a key-operated lock cylinder incorporating rotary disc tumblers and a sidebar locking element, said warding tumbler being formed with at least one gate opening or notch disposed to extend radially into the periphery thereof, said gate opening being arcuately displaced from alignment with said sidebar in the locked condition of said lock, said opening being aligned with said sidebar by rotation of said warding tumbler in said lock by said key, said warding tumbler having a key entry opening formed in any one of a plurality of non-symmetrical configurations, said key entry opening in said warding tumbler serves to prevent relative movement between said warding tumbler and a correspondingly shaped key in the operation of said warding tumbler.

* * * * *